US011136799B2

(12) United States Patent
Hughes

(10) Patent No.: US 11,136,799 B2
(45) Date of Patent: Oct. 5, 2021

(54) DOOR STOP

(71) Applicant: Richard D. Hughes, Denver, CO (US)

(72) Inventor: Richard D. Hughes, Denver, CO (US)

( * ) Notice: Subject to any disclaimer, the term of this patent is extended or adjusted under 35 U.S.C. 154(b) by 240 days.

(21) Appl. No.: 16/403,577

(22) Filed: May 5, 2019

(65) Prior Publication Data

US 2019/0338571 A1 Nov. 7, 2019

Related U.S. Application Data

(60) Provisional application No. 62/667,537, filed on May 6, 2018.

(51) Int. Cl.
*E05C 17/54* (2006.01)

(52) U.S. Cl.
CPC ..... *E05C 17/54* (2013.01)

(58) Field of Classification Search
CPC ..... E05C 17/54; E05C 17/52; E05C 19/004; E05C 19/18; Y10S 292/15; Y10S 16/17; Y10S 16/21; E05F 5/06; E05F 5/00; E05B 2015/1692; E05B 65/0894; E05B 45/06

See application file for complete search history.

(56) References Cited

U.S. PATENT DOCUMENTS 1,042,329 A * 10/1912 Daniels ..... E05C 17/54 292/343
1,833,773 A * 11/1931 Brooks ..... E05C 17/54 292/343
2,122,312 A * 6/1938 Cassion ..... E05C 17/54 292/342
4,114,936 A * 9/1978 Dominguez ..... E05C 17/54 292/342
9,644,407 B1 * 5/2017 Abramovits ..... E05C 17/54
D860,775 S * 9/2019 Kazutaka ..... D8/402
10,760,309 B1 * 9/2020 Bowman ..... E05C 17/54
2006/0163888 A1 * 7/2006 Bowser ..... E05C 17/54 292/343
2008/0079269 A1 * 4/2008 Bushey ..... E05C 17/54 292/342
2009/0302622 A1 * 12/2009 Fritz ..... E05C 17/52 292/343
2014/0084606 A1 * 3/2014 Packer ..... E05C 17/54 292/343

* cited by examiner

*Primary Examiner* — Mark A Williams
(74) *Attorney, Agent, or Firm* — Roger A. Jackson

(57) ABSTRACT

A door stop that includes a planar base having a proximal end portion and an opposing distal end portion with a longitudinal axis spanning therebetween, further included in the door stop is a flexible cantilever arm having a primary end portion and an opposing secondary end portion with a lengthwise axis spanning therebetween, wherein the primary end portion is flexibly affixed to the proximal end portion with the secondary end portion being a free cantilever end, wherein the longitudinal and lengthwise axes form a first acute angle to one another.

Also included in the door stop is an extension element extending from the distal end portion in a substantially perpendicular manner toward the cantilever end, wherein operationally the proximal end portion is pushed under a door thereby reducing the first acute angle until the extension element contacts the door to frictionally hold a door in a selected position.

3 Claims, 8 Drawing Sheets

DOOR STOP

RELATED APPLICATION

This application claims the benefit of U.S. provisional patent application Ser. No. 62/667,537 filed on May 6, 2018 by Richard D, Hughes of Denver, Colo., U.S.

FIELD OF THE INVENTION

The present invention generally relates to door stops for removably engaging a door to a selected pivotal position. More particularly, the present invention discloses a special door stop that is cantilevered to a base minimize a floor protrusion beyond the door for lessening any floor obstruction to reduce chances of stumbling or tripping on the door stop from an individual.

DESCRIPTION OF THE RELATED ART

Traditional door stops are typically an elongated flexible wedge of rubber that usually extends beyond the outer bottom edges of the door as the wedge is fairly long to accommodate different door bottom heights to a floor surface.

Looking in particular at the door stop prior arts in U.S. Pat. No. 5,331,719 to Hum et al., discloses a door stop that is formed form a single flexible band of sheet metal in an arcuate shape, thus the arch convex portion has a high friction surface as well as a single one of the opposing ends on the concave portion of the arch thus allowing the other convex opposing end with a low friction contact on the surface to allow flexture of the arch when in contact with the door bottom. The Hum device sticks out of both ends of the door bottom and does not have an end retainer to eliminate the extension that is outside the door.

Next, in the door stop prior arts in U.S. Pat. No. 5,207,464 to Reeves, disclosed is a two piece door stop that uses a screw bolt to create an angled fulcrum straight section to wedge as between the floor and the door, thus one side of the door bottom does not have any protrusion but the other side of the door bottom has a significant protrusion which could be a tripping hazard.

Further in the door stop prior arts in U.S. Pat. No. 1,833,773 to Brooks, discloses a spring wedge door stop, however, not having an end portion, wherein the Brooks door stop extends out of both sides of the door bottom. There is a feature of Brooks that is of note in that the extended length of the angled section beyond the bottom door edge allows for a person's foot to step on the angled section to loosen the contact as between the door bottom and the floor, thus allowing the door open freely.

Continuing, in the door stop prior art in U.S. Pat. No. 2,048,274 to Luby, disclosed is a permanently installed (on the floor) spring arc door holder that also extends beyond both sides of the door bottom again causing a floor foot trip hazard.

Next, in the door stop prior art in U.S. Pat. No. 2,784,443 to VonBerg, discloses again, similar to Luby, a permanently installed (on the floor) spring arc door holder that also extends beyond both sides of the door bottom again causing a trip hazard, also having an optional rubber stop on one side of the door.

Moving onward in the door stop prior art in U.S. Pat. No. 3,054,632 to Welch, disclosed is a door stop similar to Hum, except without the high friction surface and using instead a shoulder (see element 26) to stop the door movement, however, still having the undesirable extension beyond both sides of the bottom of the door on the floor that can cause a tripping hazard.

Further in the door stop prior art in U.S. Pat. No. 4,044,424 to Sasgen, disclosed is a door stop having the vertical upright (see element 10), however the lower portion being close to Hum with the convex spring steel section, Sasgen does work toward not having any floor extensions beyond the bottom of the door which is good for removing the trip hazard.

This gives an idea of the current state of the art in the spring door stop wedge arts, wherein the references Hum and Sasgen have the leaf spring wedge portion, such that Hum has an arcuate leaf spring that has both ends contacting the floor, i.e. such that Hum extends beyond the door bottom on both sides being a tripping hazard, and Sasgen is similar having the arcuate spring, however, just being the width of the door with a vertical extension to retain the door from lateral movement.

What is needed is a spring wedge door stop that does not extend any more than minimally beyond the bottom door edges to lessen any chance of an individual tripping while holding the door in a selected pivotal position in relation to the floor.

SUMMARY OF INVENTION

Broadly, the present invention is a door stop for a door, that includes a planar base having a proximal end portion and an opposing distal end portion with a longitudinal axis spanning therebetween, further included in the door stop is a flexible cantilever arm having a primary end portion and an opposing secondary end portion with a lengthwise axis spanning therebetween, wherein the primary end portion is flexibly affixed to the proximal end portion with the secondary end portion being a free cantilever end, wherein the longitudinal and lengthwise axes form a first acute angle to one another.

Also included in the door stop is an extension element extending from the distal end portion in a substantially perpendicular manner toward the cantilever end, wherein operationally the proximal end portion is pushed under a door thereby reducing the first acute angle until the extension element contacts the door to frictionally hold the door in a selected position.

These and other objects of the present invention will become more readily appreciated and understood from a consideration of the following detailed description of the exemplary embodiments of the present invention when taken together with the accompanying drawings, in which;

Figure 5:
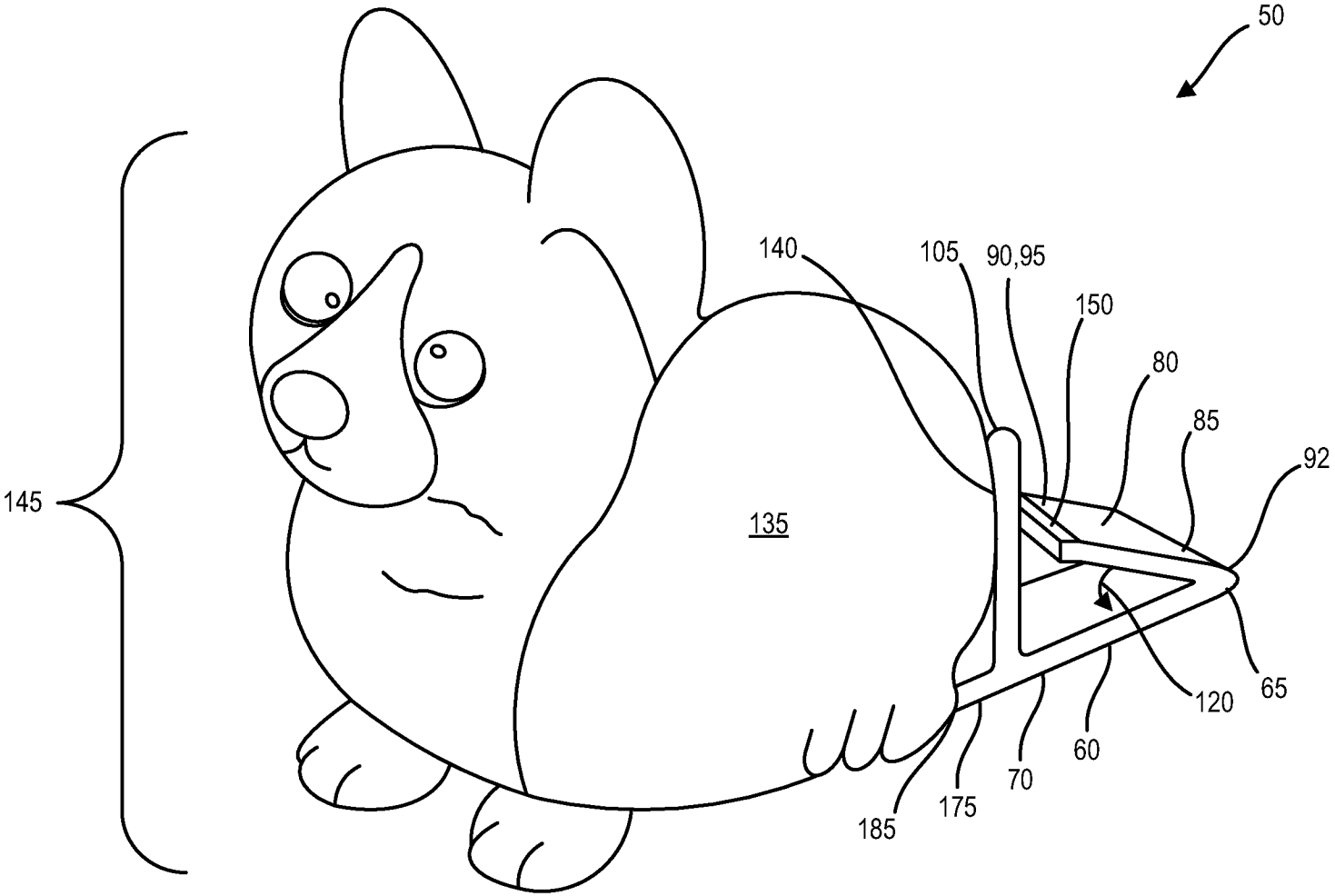
Figure 6:
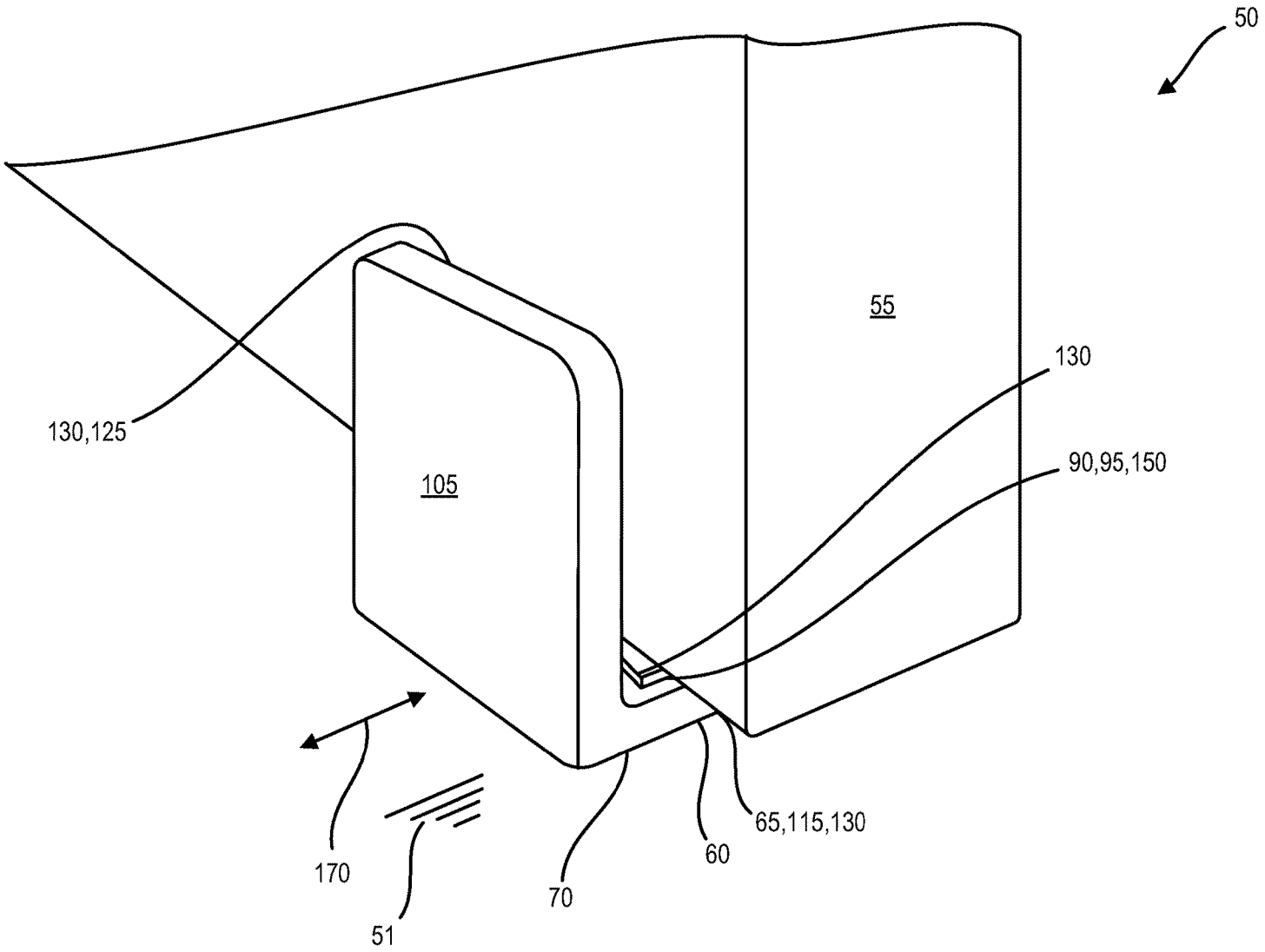
Figure 7:
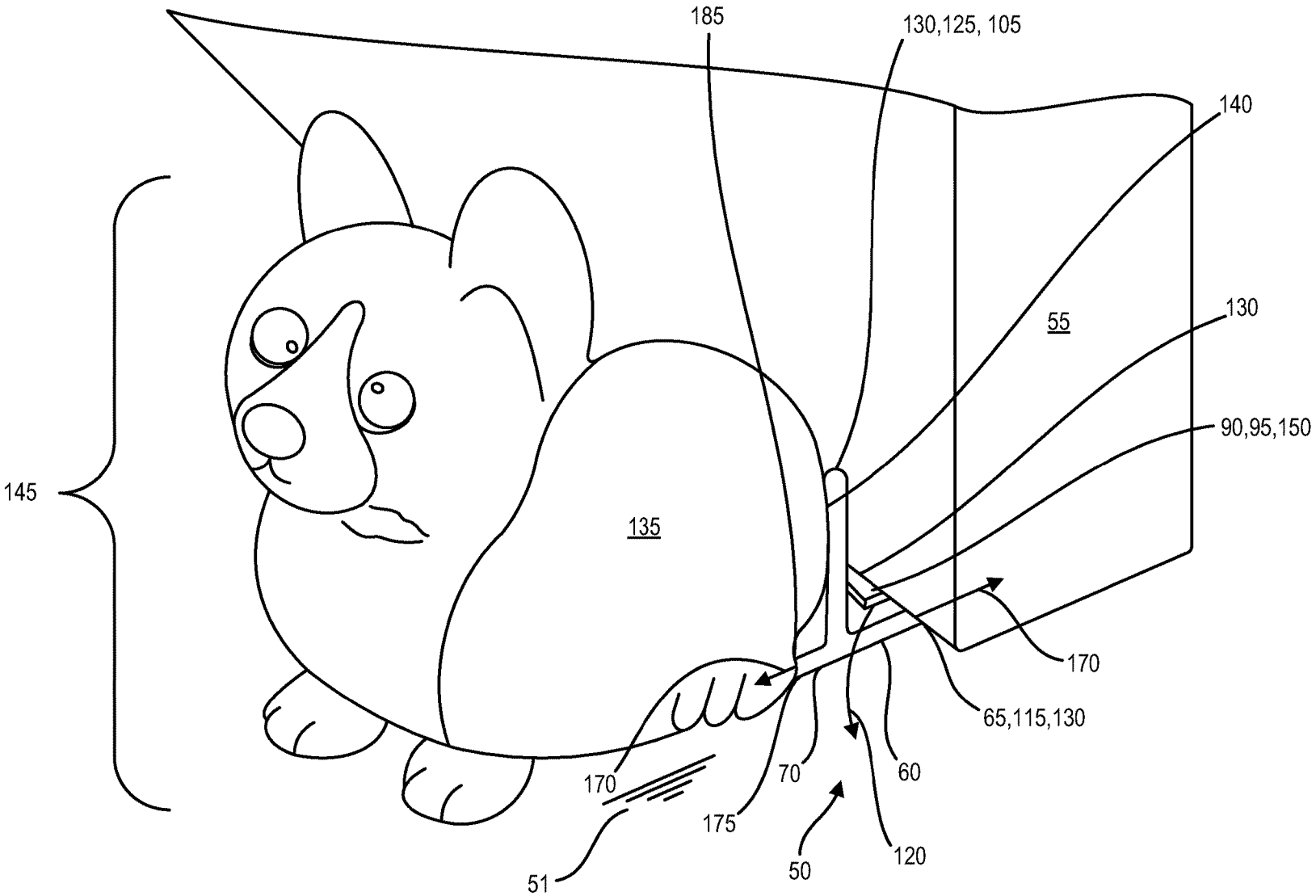
Figure 8:
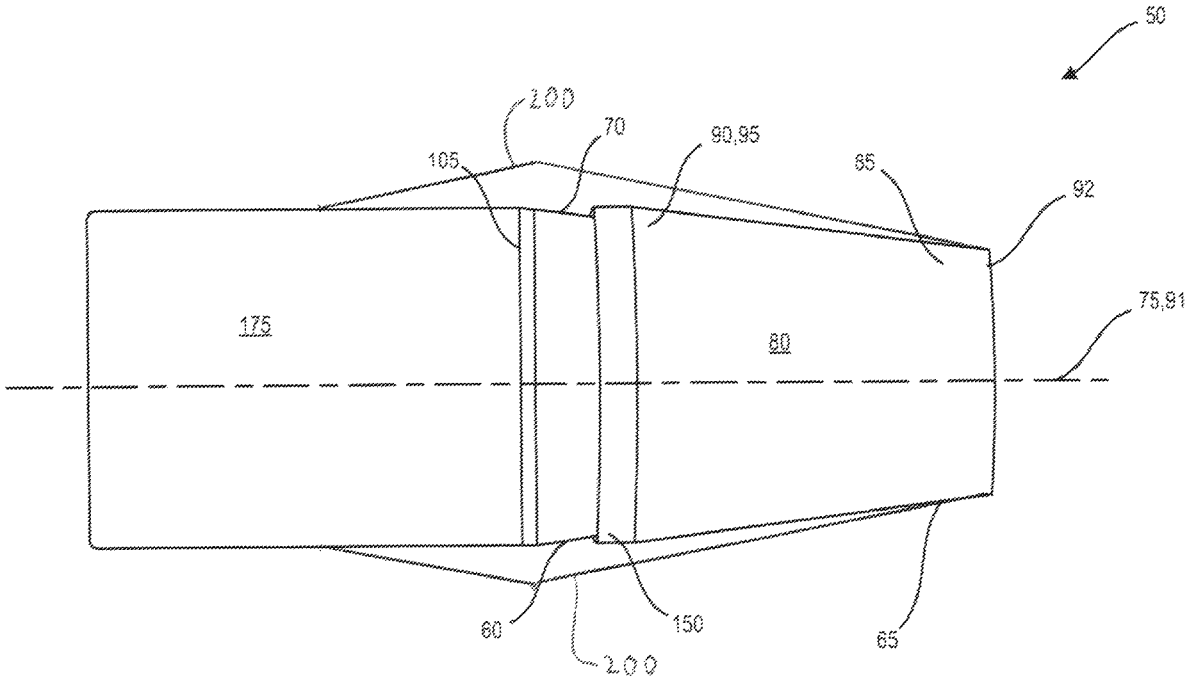

4 shows the planar base, the longitudinal axis, the lengthwise axis, the flexible cantilever arm, the first acute angle, the extension element, and the flat section;

FIG. 5 shows an upper perspective view of the door stop with the addition of the optional figurine, FIG. 5 also shows the planar base, the longitudinal axis, the lengthwise axis, the flexible cantilever arm, the first acute angle, the extension element, the flat section, and the base extension element;

FIG. 6 shows an upper perspective view of the door stop in use with a door and a surface being without the optional base extension element and the figurine, with FIG. 6 also showing the planar base, a secondary end portion of the flexible cantilever arm, the extension element, and the flat section;

FIG. 7 shows an upper perspective view of the door stop in use with the door and the surface being with the optional base extension element and with the figurine shown, with FIG. 7 also showing the planar base, a secondary end portion of the flexible cantilever arm, the extension element, the flat section, and the base extension element; and FIG. 8 shows a top plan view of the door stop that shows the planar base, the longitudinal axis, the flexible cantilever arm, the extension element, the flat section, and the base extension element, also shown in the optional expansion of the planar base that can include the base extension element.

REFERENCE NUMBERS IN DRAWINGS

50 Door stop
51 Surface
55 Door
60 Planar base
65 Proximal end portion of the planar base 60
70 Distal end portion of the planar base 60
75 Longitudinal axis of the planar base 60
80 Flexible cantilever arm
85 Primary end portion of the flexible cantilever arm 80
90 Secondary end portion of the flexible cantilever arm 80
91 Lengthwise axis of the flexible cantilever arm 80
92 Flexibly affixed primary end portion 85 to the proximal end portion 65
95 Free cantilever end of the flexible cantilever arm 80
100 First acute angle of longitudinal axis 75 to the lengthwise axis 91
105 Extension element
110 Substantially perpendicular manner of the extension element 105 from the distal end portion
115 Pushed proximal end portion 65 under the door 55
120 Reducing the first acute angle 100
125 Extension element 105 contacts the door 55
130 Frictionally holding the door 55 in a selected position
135 Figurine
140 Figurine 135 affixed to the extension element 105
145 Figurine 135 hiding the door stop 50
150 Flat section
155 Planar axis of the flat section 150
160 Second acute angle
165 Second acute angle 160 being less that the first acute angle 100
170 Smooth insertion and removal of the door stop 50 from the door 55
175 Base extension element
180 Parallel plane of the base extension element 175 extending in relation to the planar base 60
185 Further support of the figurine 135
200 Expansion of the planar base 60 that can include the base extension element 175

DETAILED DESCRIPTION

Figure 1:
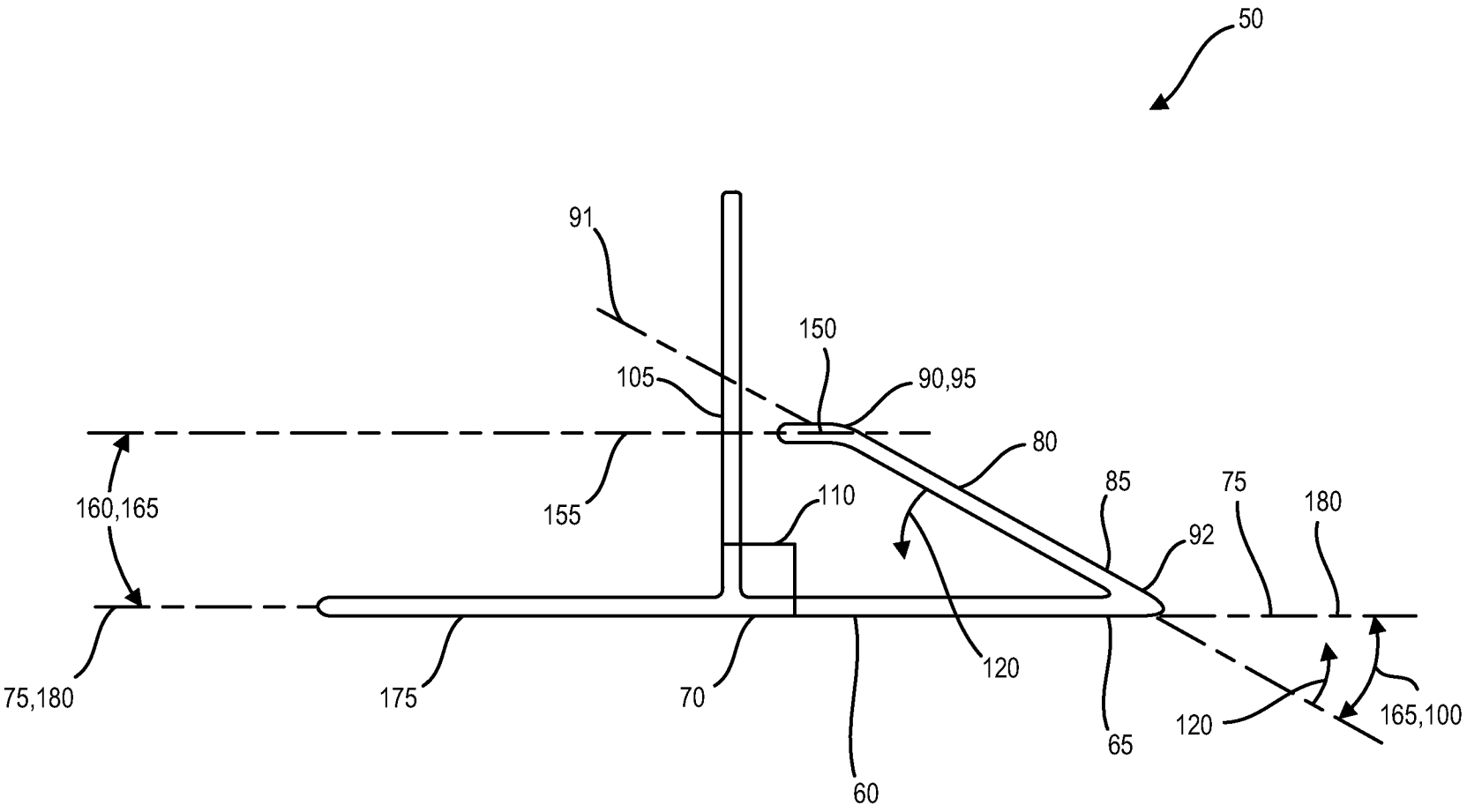
FIG. 1 shows a side elevation view of the door stop that shows a planar base, a longitudinal axis, a lengthwise axis a flexible cantilever arm, a first acute angle, an extension element, a flat section, and a base extension element.

With initial reference to FIG. 1 shown is the side elevation view of the door stop 50 that shows the planar base 60, the longitudinal axis 75, the lengthwise axis 91, the flexible cantilever arm 80, the first acute angle 100, the extension element 105, the flat section 150, and the base extension element 175.

Figure 2:
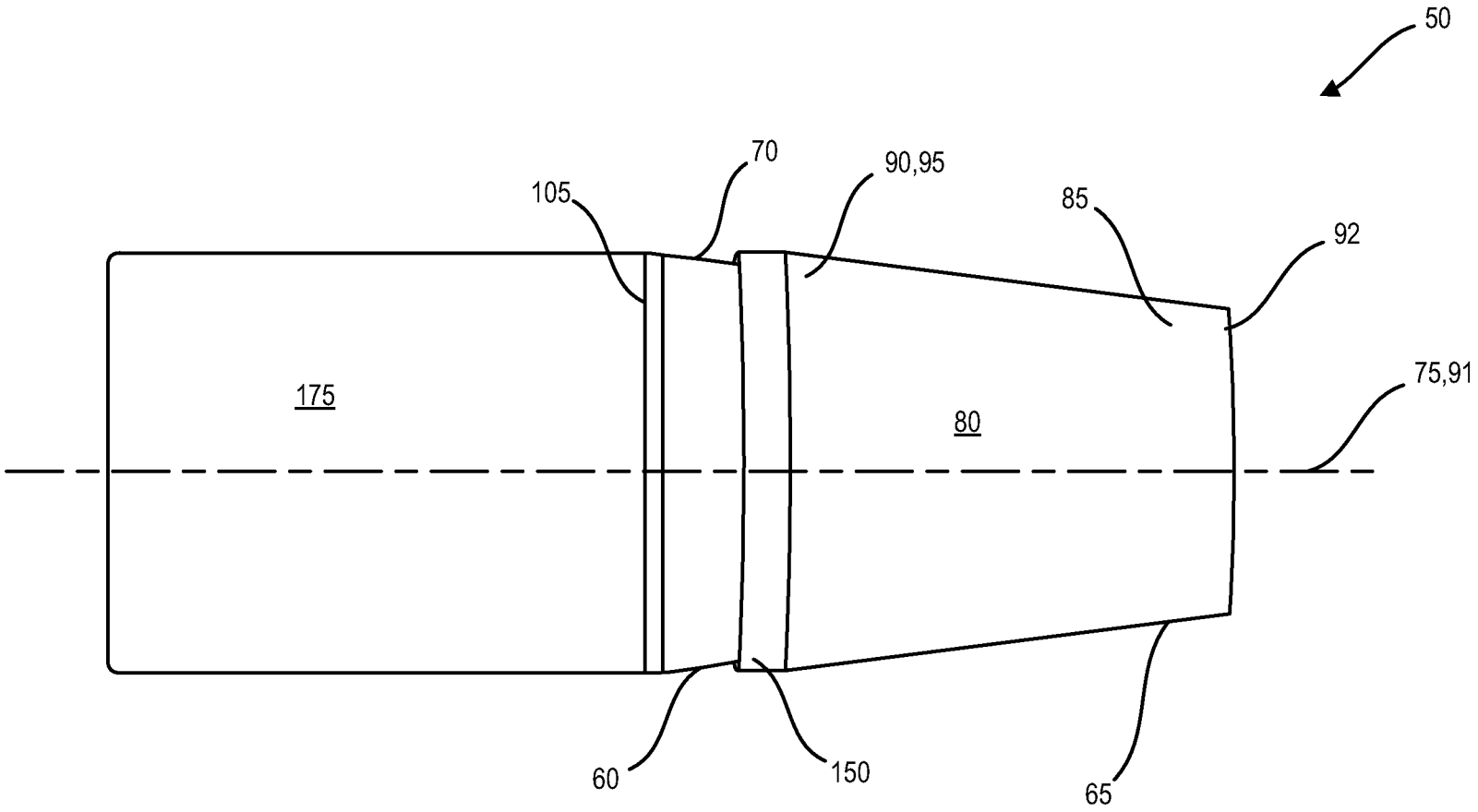
FIG. 2 shows a top plan view of the door stop that shows the planar base, the longitudinal axis, the flexible cantilever arm, the extension element, the flat section, and the base extension element.

Next, FIG. 2 shows a top plan view of the door stop 50 that shows the planar base 60, the longitudinal axis 75, the flexible cantilever arm 80, the extension element 105, the flat section 150, and the base extension element 175.

Figure 3:
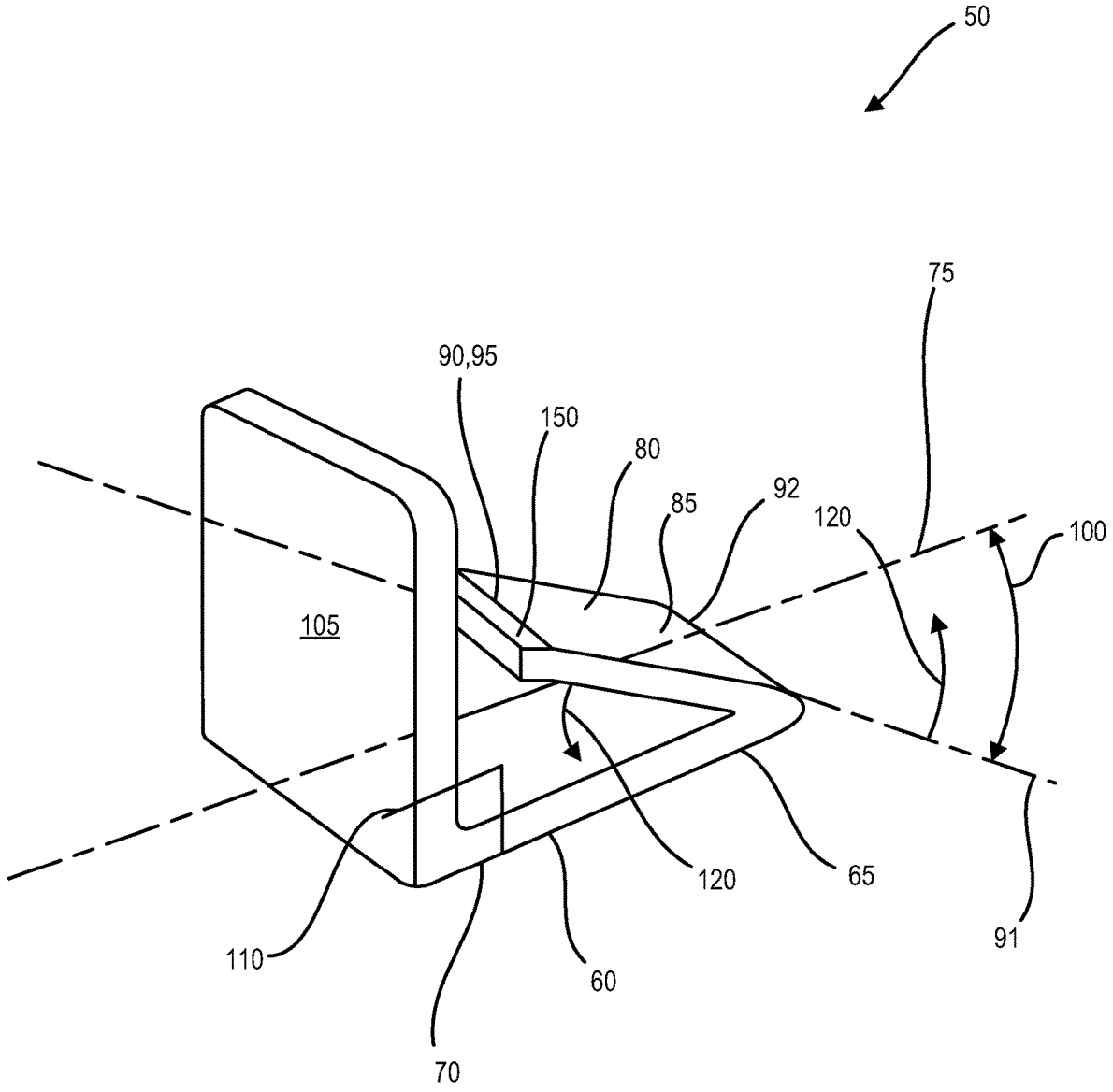
FIG. 3 shows an upper perspective view of the door stop that shows the planar base, the longitudinal axis, the lengthwise axis, the flexible cantilever arm, the first acute angle, the extension element, and the flat section.

Continuing, FIG. 3 shows an upper perspective view of the door stop 50 that shows the planar base 60, the longitudinal axis 75, the lengthwise axis 91, the flexible cantilever arm 80, the first acute angle 100, the extension element 105, and the flat section 150.

Figure 4:
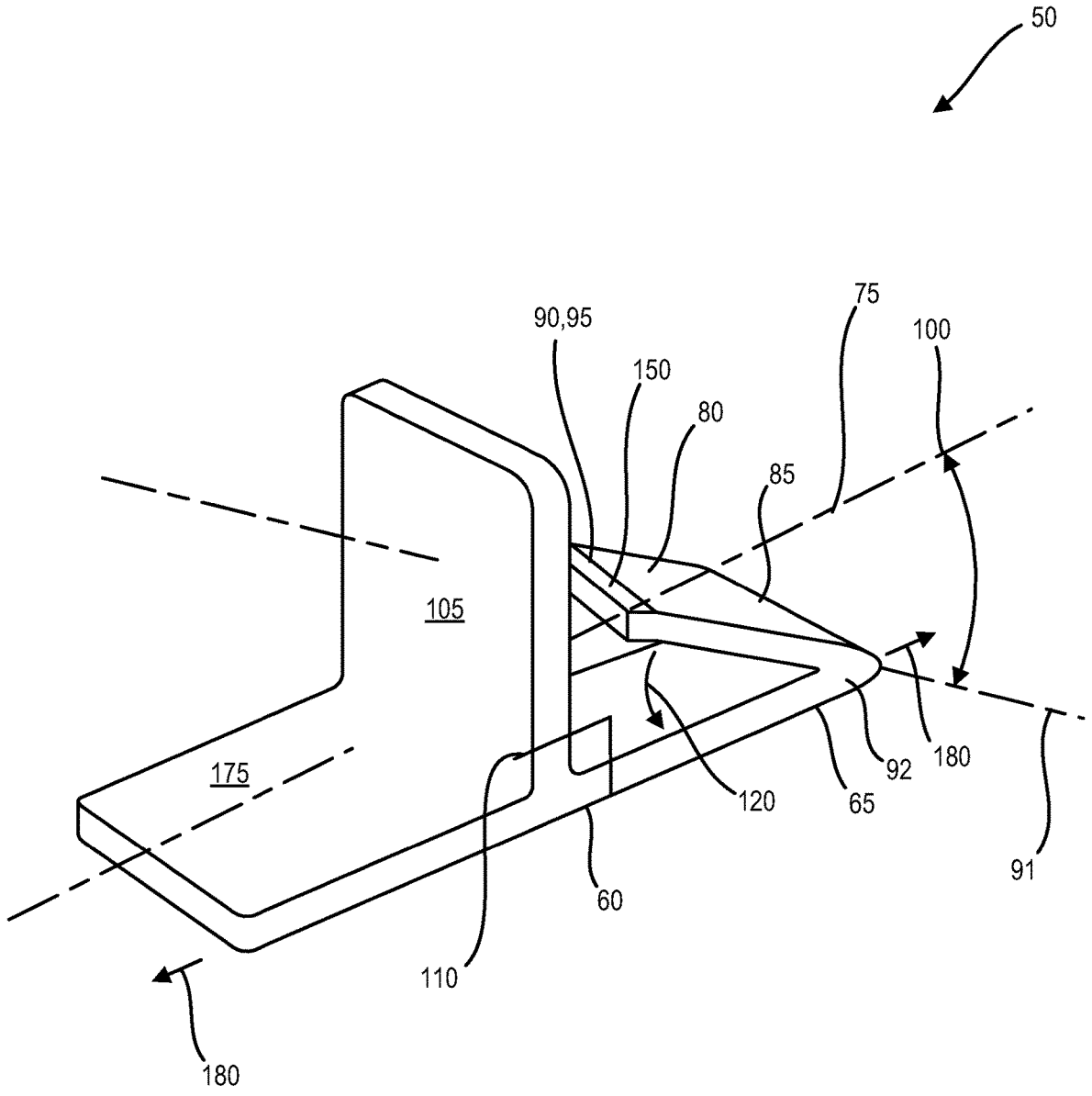
FIG. 4 shows the FIG. 3 view with the addition of the base extension element as an option for the door stop, thus FIG.

Further, FIG. 4 shows the FIG. 3 view with the addition of the base extension element 175 as an option for the door stop 50, thus FIG. 4 shows the planar base 60, the longitudinal axis 75, the lengthwise axis 91, the flexible cantilever arm 80, the first acute angle 100, the extension element 105, and the flat section 150.

Moving onward, FIG. 5 shows an upper perspective view of the door stop 50 with the addition of the optional figurine 135, FIG. 5 also shows the planar base 60, the longitudinal axis 75, the lengthwise axis 91, the flexible cantilever arm 80, the first acute angle 100, the extension element 105, the flat section 150, and the base extension element 175.

Yet further, FIG. 6 shows an upper perspective view of the door stop 50 in use with a door 55 and a surface 51 being without the optional base extension element 175 and the figurine 135, with FIG. 6 also showing the planar base 60, the secondary end portion 90 of the flexible cantilever arm 80, the extension element 105, and the flat section 150.

Continuing, FIG. 7 shows an upper perspective view of the door stop 50 in use with the door 55 and the surface 51 being with the optional base extension element 175 and with the figurine shown 135, with FIG. 7 also showing the planar base 60, the secondary end portion 90 of the flexible cantilever arm 80, the extension element 105, the flat section 150, and the base extension element 175.

Further, FIG. 8 shows a top plan view of the door stop 50 that shows the planar base 60, the longitudinal axis 75, the flexible cantilever arm 80, the extension element 105, the flat section 150, and the base extension element 175, also shown in the optional expansion 200 of the planar base 60 that can include the base extension element 175 for increased stability of the door stop 50 on the surface 51.

Broadly, the present invention as shown in FIGS. 1 to 4, is the door stop 50 for the door 55 as against the surface 51, shown in use in FIGS. 6 and 7, the door stop 50 including the planar base 60 having a proximal end portion 65 and an opposing distal end portion 70 with the longitudinal axis 75 spanning therebetween, further included in the door stop 50 is the flexible cantilever arm 80 having a primary end portion 85 and an opposing secondary end portion 90 with a lengthwise axis 91 spanning therebetween, wherein the primary end portion 85 is flexibly affixed 92 to the proximal end portion 65 with the secondary end portion 90 being a free cantilever end 95, wherein the longitudinal 75 and lengthwise 91 axes form the first acute angle 100 to one another, see in particular FIG. 1 and FIGS. 2 to 4.

Also included in the door stop 50 is the extension element 105 extending from the distal end portion 70 in a substantially perpendicular manner 110 toward the cantilever end 95, wherein operationally the proximal end portion 65 is pushed 115 under the door 55 thereby reducing 120 the first acute angle 100 until the extension element 105 contacts 125 the door 55 to frictionally hold 130 the door 55 in a selected position, see in particular FIGS. 6 and 7.

Alternatively on the door stop 50 can further comprise the figurine 135 affixed 140 to the extension element 105 disposed opposite of the cantilever arm 80 to operationally substantially hide 145 the door stop 50, see FIG. 7.

Another alternative for the door stop 50 wherein the cantilever arm 80 free end 95 can further comprise the insertion and removal flat section 150 having a planar axis 155 hat forms a second acute angle 160 with the longitudinal axis 75 that is less 165 than the first acute angle 100 to operationally facilitate smooth insertion and removal 170 from the door 55 of the door stop 50, see FIGS. 6 and 7.

A further alternative for the door stop 50 can further comprise the base extension element 175 disposed on the planar base 60 extending in a plane parallel 180 to the planar base 60 away from the extension element 175 oppositely positioned to the cantilever end 95 to operationally further support 185 the figurine 135, see in particular FIGS. 1, 2, and 4, plus FIGS. 5 and 7.

CONCLUSION

Accordingly, the present invention of a door stop has been described with some degree of particularity directed to the embodiments of the present invention. It should be appreciated, though; that the present invention is defined by the following claim construed in light of the prior art so modifications of the changes may be made to the exemplary embodiments of the present invention without departing from the inventive concepts contained therein.

The invention claimed is:

1. A door stop for a door, said door stop comprising:

(a) a planar base having a proximal end portion and an opposing distal end portion with a longitudinal axis spanning therebetween;

(b) a flexible cantilever arm having a primary end portion and an opposing secondary end portion with a lengthwise axis spanning therebetween, wherein said flexible cantilever arm primary end portion is flexibly affixed to said planar base proximal end portion at a first acute angle defined by said longitudinal axis and said lengthwise axis with said flexible cantilever arm secondary end portion terminating into a free moving cantilever end being suspended over said planar base distal end portion;

(c) an extension element extending from said planar base distal end portion in a perpendicular manner toward "and extending past" said "flexible cantilever arm" cantilever end such that said extension element and said planar base form a right angle to one another; and (d) a base extension element disposed on said planar base distal end portion extending in a plane parallel to said planar base away from said extension element being oppositely positioned to said flexible cantilever arm cantilever end in relation to said extension element, such that said base extension element and said extension element form a right angle to one another, said base extension element extending greater than or equal to said planar base distance between said distal and proximal end portions such that said extension element extends at a right angle from a combination of said planar base and said base extension elements wherein said right angle is positioned substantially at a midpoint of said combination of said planar base and said base extension elements, wherein operationally an individual manually foot pushes against said base extension element and said extension element right angle interface to one another resulting in said planar base proximal end portion being pushed under a door thereby reducing said first acute angle via compressing said flexible cantilever arm toward said planar base placing said flexible cantilever arm in a compressed state until said extension element contacts the door to frictionally hold the door in a selected position, wherein with said flexible cantilever arm remaining in said compressed state as against the door to provide said frictionally hold of the door in the selected position, wherein dislodging the door from said door stop only requires manually pushing the door away from said extension element.

2. A door stop according to claim 1 further comprising a figurine affixed to said base extension element with said figurine also being adjacent to said extension element at said right angle formed between said base extension element and said extension element, wherein said figurine is disposed opposite of said cantilever arm relative to said extension element to operationally substantially hide said door stop.

3. A door stop according to claim 1 wherein said "flexible cantilever arm secondary end portion" further comprises a termination having a flat section that is in relation to said flexible cantilever arm being at said first acute angle, said flat section having a planar axis that forms a second acute angle with said longitudinal axis when said flexible cantilever arm is in said compressed state, wherein said second acute angle is less than said first acute angle to operationally facilitate smooth insertion and removal "of said flexible cantilever arm secondary end portion free cantilever end" to and from under the door of said door stop.

* * * * *